United States Patent [19]

Dommerud

[11] Patent Number: 4,799,274

[45] Date of Patent: Jan. 24, 1989

[54] FOLDING STRETCHER

[75] Inventor: Svein A. Dommerud, Nesbru, Norway

[73] Assignee: A/S Apotekernes Faellesindkjop, Oslo, Norway

[21] Appl. No.: 74,535

[22] PCT Filed: Nov. 17, 1986

[86] PCT No.: PCT/NO86/00076

§ 371 Date: Jun. 19, 1987

§ 102(e) Date: Jun. 19, 1987

[87] PCT Pub. No.: WO87/02886

PCT Pub. Date: May 21, 1987

[30] Foreign Application Priority Data

Nov. 18, 1985 [NO] Norway ..... 854599

[51] Int. Cl.[4] ..... A61G 1/00

[52] U.S. Cl. ..... 5/82 R; 5/116; 5/310

[58] Field of Search ..... 5/8, 82 R, 110, 111, 5/114, 116, 117, 310, 314 R

[56] References Cited

U.S. PATENT DOCUMENTS

| | | | |
|---|---|---|---|
| 1,305,388 | 6/1919 | Luria | 5/82 |
| 2,087,984 | 7/1937 | McAfee et al. | 5/187 X |
| 2,640,996 | 6/1953 | Davis | 5/8 |
| 2,722,690 | 11/1955 | Donargo | 5/8 |
| 3,104,401 | 9/1963 | Davis | 5/82 |
| 3,336,060 | 8/1967 | Bradford | 5/8 X |

*Primary Examiner*—Alexander Grosz
*Assistant Examiner*—Michael F. Trettel
*Attorney, Agent, or Firm*—Finnegan, Henderson, Farabow, Garrett & Dunner

[57] ABSTRACT

A stretcher system comprises two longitudinal profiles (3) between which a stretcher sheet (2) is stretched, said profiles (3) being provided with brackets (5) between which are provided foldable transversal stiffening members (4), said brackets (5) being provided with through openings (7,8) for insertion of leg and support members securable by the aid of clamping screws.

1 Claim, 4 Drawing Sheets

FOLDING STRETCHER

The present invention relates to a folding stretcher that may assembled in a simple manner, is strong, lightweight, and does not require much space in storage.

Several of the so called life-saving, emergency, and stand-by services have tried for a long time to develop a stretcher system which, being inexpensive in production, also presents a sufficient degree of solidity, service life, and ease in use.

Known technology disclosed a long series of stretchers of various kind. Furthermore, a long series of so called "stacking" hospital beds are known. However, none of these known techniques disclose a combined system permitting, e.g. that an ordinary ambulance stretcher in an emergency can be transformed into a bed by simple movements and in a short time.

It is an object of the present invention to eliminate this difficulty and, thus, discloses a stretcher system comprising relatively few basic members which, with a simple assembly, may be used as an ambulance stretcher, a surgical table, a transport and evacuation stretcher, and, if necessary, as an ordinary two-storeyed bunk, or a single bed.

Figure 1:
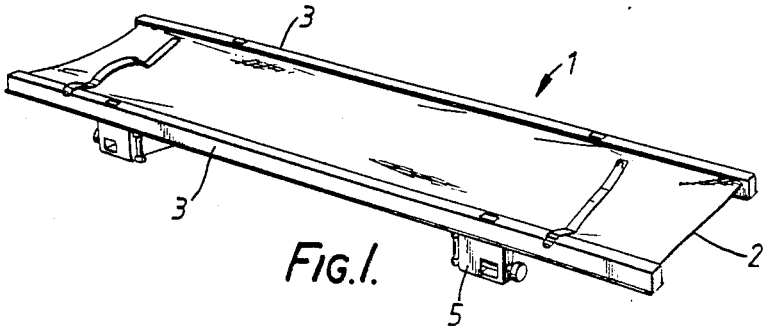
Figure 2:
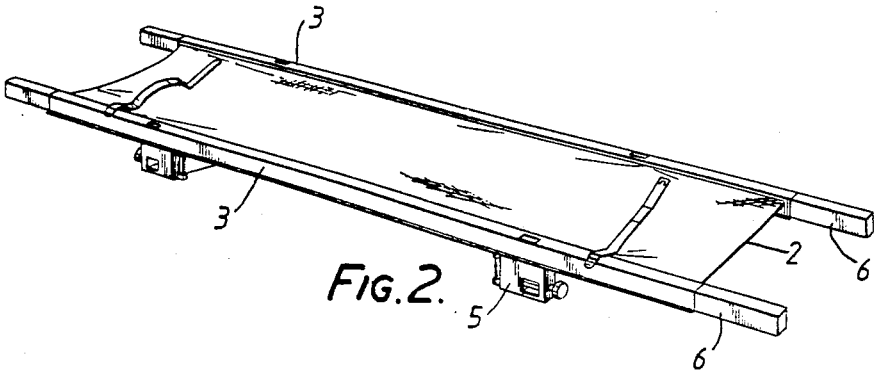
Figure 3:
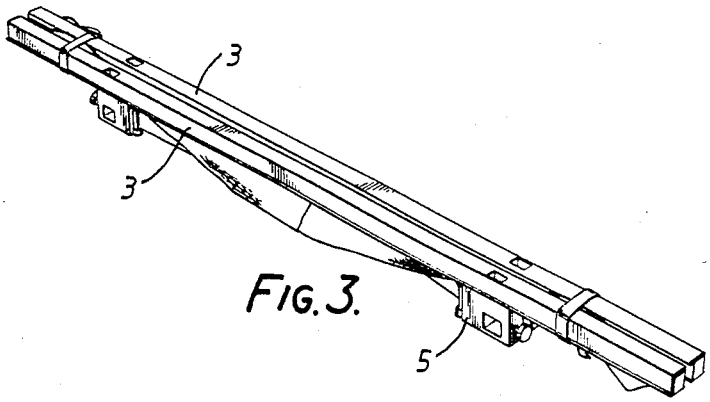
Figure 4:
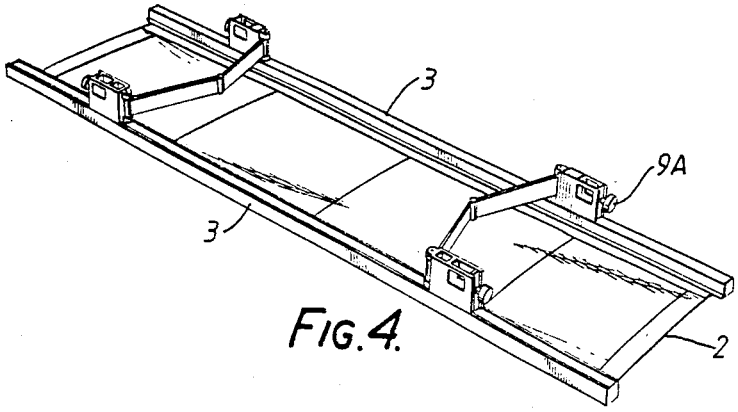
Figure 5:
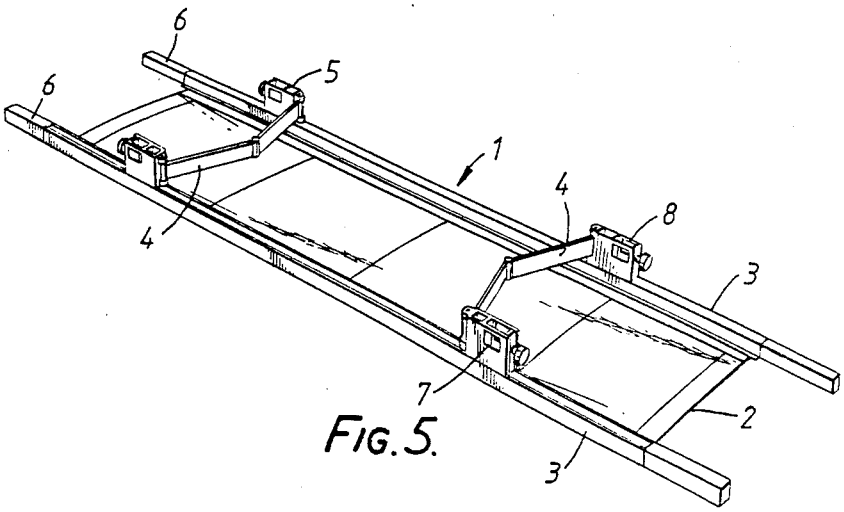
Figure 6:
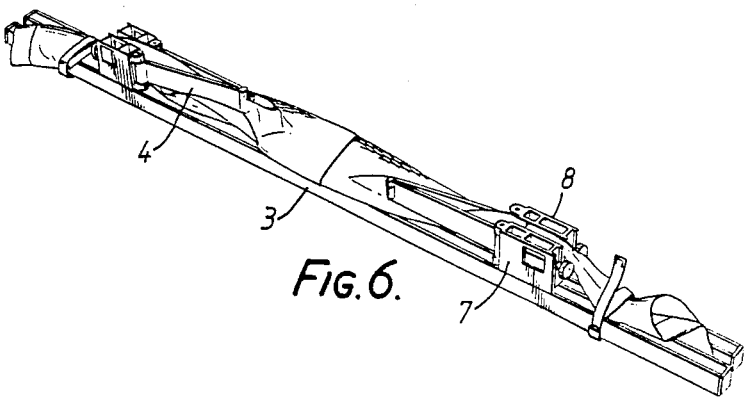
Figure 7:
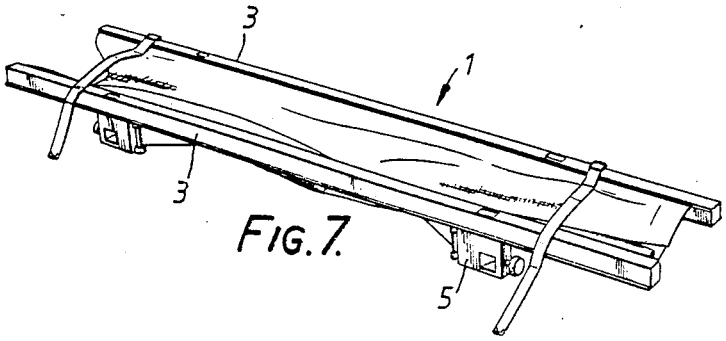
Figure 8:
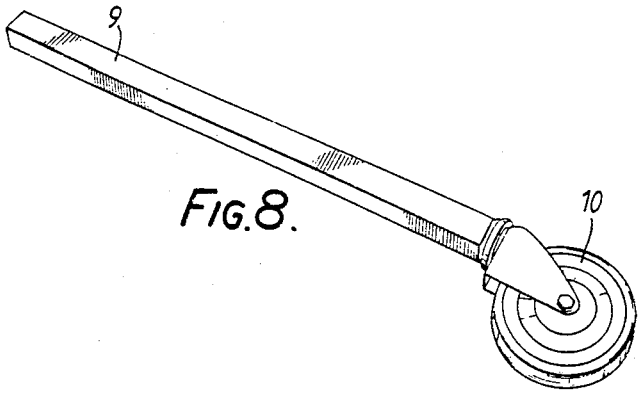
Figure 9:
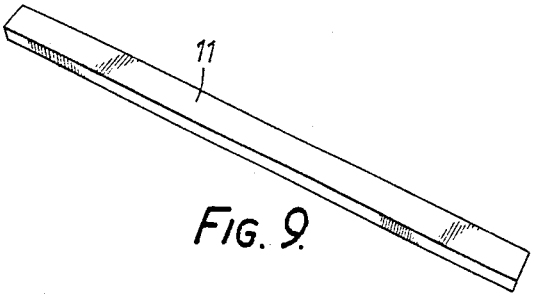
Figure 10:
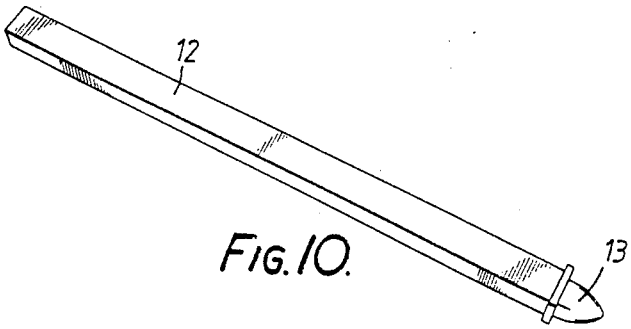
Figure 11:
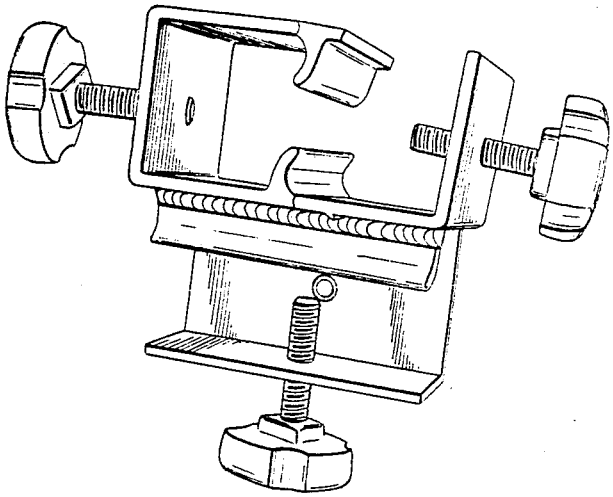
Figure 12:
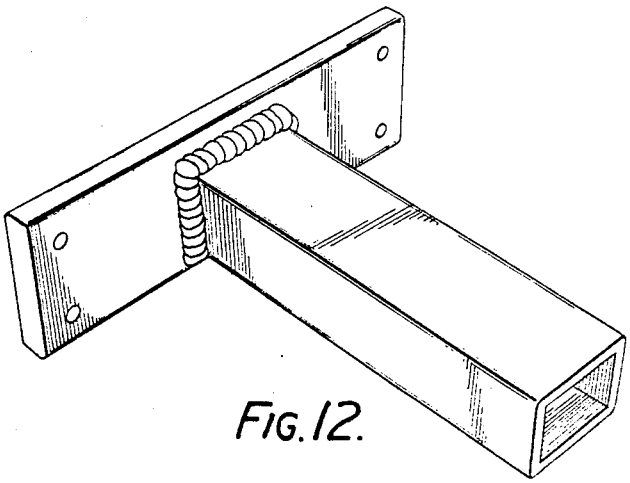

In the following, the invention is disclosed in more detail with reference to the accompanying drawings, wherein FIG. 1 shows the object of the invention in a plan view, FIG. 2 shows the object of the invention in a plan view with extended carrying handles, also seen in plan view, FIG. 3 shows the object of the invention a folded state in a plan view, FIG. 4 shows the object of the invention in a set-up state, shown in an inverted plan view, FIG. 5 shows the object of the invention in a set-up state, shown in an inverted plan view and with extended carrying handles, FIG. 6 shows the object of the invention in a folded state as seen in an inverted plan view, FIG. 7 shows the object of the invention in a partly folded state, as seen in a plan view, FIG. 8 shows a leg with rollers, FIG. 9 shows a joining and lengthening member, FIG. 10 shows a lengthened element with a foot element, FIG. 11 shows a joining and lengthening bracket, and FIG. 12 shows a foot bracket for mounting, e.g. on skis.

The object of the invention, the stretcher 1, comprises the following members.

A sheet 2 is stretched between two longitudinal profiles 3. The tension force is provided by two foldable transversal stiffening members 4 secured to brackets 5 mounted on said profiles 3.

In said longitudinal profiles 3 extendable carrying handles 6 are provided.

Brackets 5 are provided with through openings 7, 8 with clamping screws 9A.

Said openings 7, 8 are intended for receiving, e.g. a leg member 9 with rollers 10 (see FIG. 8), an ordinary extension member 11, or an extension member 12 having a centering bolt 13.

As shown in FIG. 2, said stretcher may be used as a conventional ambulance stretcher with dimensions adapted to conventional vehicles, helicopters and aircrafts used for services of this kind.

By inserting, e.g. a leg member 9 with roller 10 through said through openings 8 it is possible, e.g. to provide a surgical table by simple movements.

Using the same stretcher 1, e.g. on skis provided with foot brackets according to FIG. 12 it is possible to provide a sledge with skis very rapidly. Said bracket in FIG. 12 is shown with a foot plate to be secured by screws. It may, obviously, be secured by a clamping device.

By using an element as shown in FIG. 11 horizontally and vertically with members according to FIGS. 8, 9, and 10 it is possible to provide almost any desired structure, practical considerations forming the only limit.

It is assumed that said profiles are made of aluminum, however, this should not exclude other materials.

By this invention a stretcher system is, thus, achieved which by the aid of simple and inexpensive members covers a wide range of application in life-saving, emergency and stand-by services, both as regards solidity, service life, and flexibility.

I claim:

1. A foldable stretcher comprising:

(a) two longitudinal profiles for supporting a stretcher sheet;

(b) a pair of brackets mounted on each of said profiles and longitudinally spaced thereon, each bracket being opposite a bracket on the other of said profiles;

(c) two foldable transversal stiffening members each having two outer ends, each end secured to one of said opposing brackets;

(d) each of said brackets having a horizontal through opening and a vertical through opening, each opening being adapted to receive an elongated member for serving as a leg or an extension and a clamping screw for holding the leg or extension in place in either opening.

* * * * *